United States Patent [19]

Savanick et al.

[11] 4,113,314

[45] Sep. 12, 1978

[54] WELL PERFORATING METHOD FOR SOLUTION WELL MINING

[75] Inventors: George A. Savanick, Apple Valley; Walter G. Krawza, Lakeville, both of Minn.

[73] Assignee: The United States of America as represented by the Secretary of the Interior, Washington, D.C.

[21] Appl. No.: 809,881

[22] Filed: Jun. 24, 1977

[51] Int. Cl.[2] ..... E21B 43/114; E21C 41/14

[52] U.S. Cl. ..... 299/4; 299/5; 166/222; 166/55

[58] Field of Search ..... 299/4, 5, 17, 16; 166/222, 55, 223, 298, 242; 175/67

[56] References Cited

U.S. PATENT DOCUMENTS

| | | | |
|---|---|---|---|
| 2,019,418 | 10/1935 | Lang | 166/269 |
| 3,055,424 | 9/1962 | Allen | 166/242 X |
| 3,130,786 | 4/1964 | Brown et al. | 175/67 X |
| 3,175,613 | 3/1965 | Hough et al. | 166/298 |
| 3,797,590 | 3/1974 | Archibald et al. | 299/17 X |
| 3,860,289 | 1/1975 | Learmont | 299/4 |
| 4,047,569 | 9/1977 | Tagirov et al. | 166/222 X |

*Primary Examiner*—Stephen J. Novosad

*Attorney, Agent, or Firm*—Thomas Zack; D. Gardiner

[57] ABSTRACT

An improved method of solution well mining is provided which, among other advantages, enhances the injectivity of the wells and eliminates the need for underreaming and the use of well screens. In solution well mining, a leaching solution is pumped into an injection well so as to flow through a mineralized zone to a plurality of production wells, the solution which contains the mineral to be recovered being pumped out of the production wells. The invention provides for using a high pressure water jet to perforate the cemented casings of the well so as to, inter alia, enhance injectivity and provide sand control. The perforations are arranged in a preselected nonuniform pattern in the production well, with the density being the greatest at the bottom of the zone, so as to promote uniform flow of the solution.

5 Claims, 3 Drawing Figures

FIG. 1
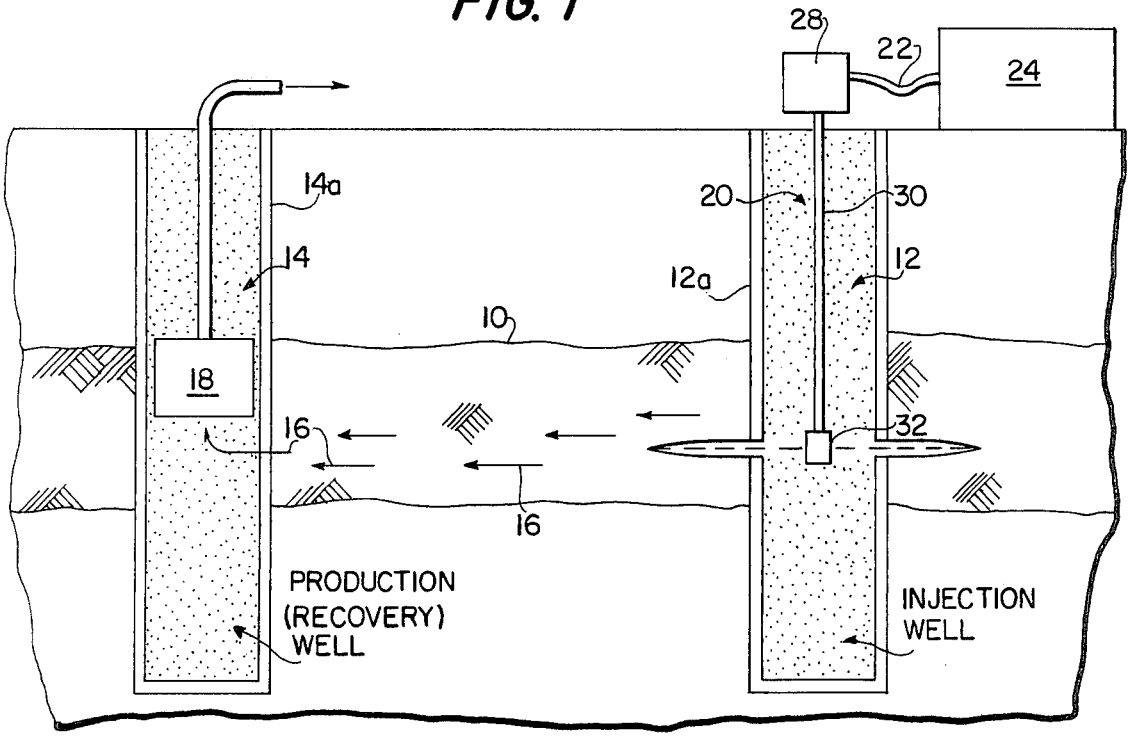
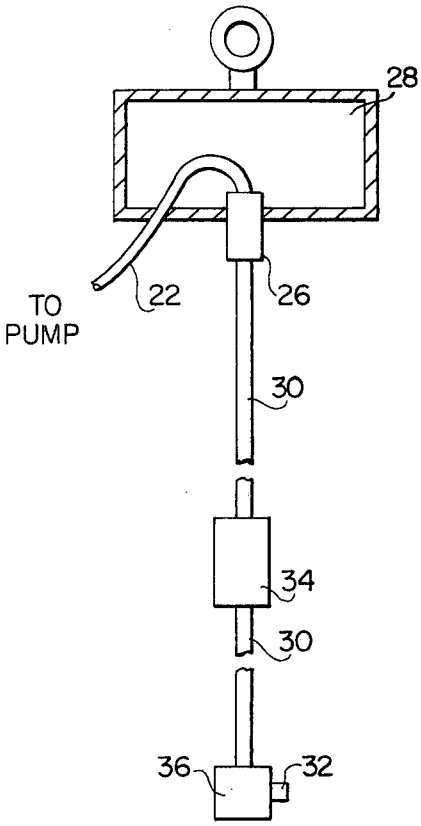
FIG. 2
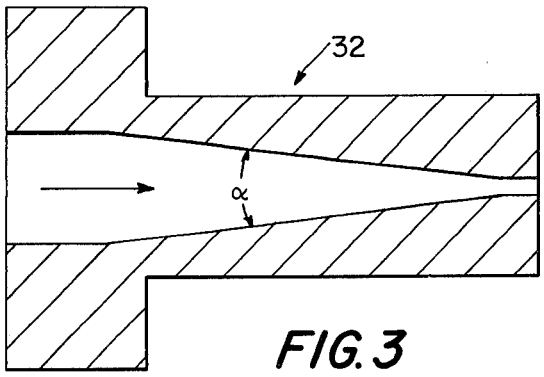
FIG. 3

WELL PERFORATING METHOD FOR SOLUTION WELL MINING

FIELD OF THE INVENTION

The present invention relates to an improved method of solution well mining and, more particular, to the use of a water jet perforator in such mining.

BACKGROUND OF THE INVENTION

As noted hereinabove, the present invention is particularly concerned with solution well mining, such as is employed in mining uranium, wherein a leaching solution is utilized. In general, such an operation employs a plurality of wells including an injection well into which the leachant is pumped and at least one production or recovery well which is located some distance from the injection well. The wells extend into a mineralized zone, i.e., a substratum containing the mineral sought to be recovered, and the leaching solution passes through the zone from the injection well to the recovery well and carries with it the mineral to be recovered, viz., uranium.

Such uranium leaching wells are conventionally cased with polyvinyl chloride and cemented to depth beyond the mineralized zone. The grouted casing in the mineralized zone is then removed with a mechanical reaming device and a so-called well screen is placed in the mineralized zone of the well. This well screen is designed to permit only essentially sand free liquid to flow into the well bore. It will be appreciated that sand must not be permitted to enter the well bore because such sand will drastically accelerate the wear of the downhole submersible centrifugal pumps used to lift the leachant to the surface. It will be understood that the process described above, wherein the well is underreamed and a well screen used to prevent the ingress of sand, is relatively expensive and time consuming.

A further, more general problem associated with uranium leaching wells is that many wells exhibit below standard injectivity so that little or no mineral recovery is achieved. Although well stimulation methods such as "acidizing" are available, these simply are not effective in many instances.

As will be discussed hereinbelow, the present invention concerns the use of a water jet perforator in uranium solution mining and like applications. It is noted that casing perforators using fluid jets have been used for cutting steel casings in oil wells. Although this art is not thought to be relevant, reference is made to U.S. Pat. Nos. 2,638,801 (Klassen et al.); 2,302,567 (O'Neill); 2,315,496 (Boynton); 3,066,735 (Zingg); and 3,130,786 (Brown et al.) which disclose various forms of perforating apparatus for this purpose. Characteristically, these apparatus employ a drill fluid which contains an abrasive such as sand or grit and/or a chemical used in enchancing perforation. The use of an abrasive jet presents operational problems particularly with regard to wear. Moreover, the pressures used are generally substantially lower than employed in accordance with the present invention.

SUMMARY OF THE INVENTION

In accordance with the present invention, a method for improving the operation of solution well mining is provided wherein high pressure jets of water are utilized to perforate the casings of the wells. This method provides for stimulation of the injection of leachant solutions through uranium leaching injection wells even where these wells exhibit subpar injectivity and do not respond to conventional well stimulation methods, such as the use of acids. Further, the method provides enhancement of the permeability of the uraniferrous sand in the vicinity of the well bore (in an annulus of about 1-foot thickness through the length of the mineralized zone) by selective removal of clay particles in the mineralized zone. In addition, the method of the invention eliminates the expense and time required in underreaming the casing and the placement of well screens to achieve sand control as described hereinabove.

A further very important feature of the method of the present invention is ability to provide a more uniform flow pattern through the mineralized zone from the injection well to the recovery well. This is accomplished by the placement of a higher density of holes of at the base of the mineralized zone than at the top of the zone near to the centrifugal suction pump. This technique is used in the recovery well to prevent "channelizing" of the mineral zone and to ensure that the centrifugal pump provides equal suction throughout the face of the zone opening on the recovery well and thus provides uniform flow within the mineralized zone.

Other features and advantages of the invention will be set forth in, or apparent from, the detailed description of a preferred embodiment found hereinbelow.

BRIEF DESCRIPTION OF THE DRAWINGS

FIG. 1 is a schematic diagram used in the explanation of the operation of a solution mining well system, with the use of a water jet perforator in accordance with the invention being illustrated therein;

FIG. 2 is a schematic side elevational view of a water jet perforator in accordance with a presently perferred embodiment of the invention;

FIG. 3 is a longitudinal cross-sectional view, to an enlarged scale, of the nozzle of FIG. 2.

DESCRIPTION OF THE PREFERRED EMBODIMENTS

As was briefly explained in the introductory portions of this application, solution well mining is a relatively recently developed technique for recovery of minerals, particularly uranium, from zones or substrata located beneath the surface of the earth. Referring to FIG. 1, such a mineralized zone is indicated at 10. The technique employs an injection well, denoted 12 in FIG. 1, and a plurality of production or recovery wells arranged about the injection well. A single recovery well 14 is shown in FIG. 1 but conventionally the wells are arranged in a five spot pattern and are spaced from the injection well by distances of between 10 and 100 feet.

The wells are characteristically 4 to 8 inches in diameter and present practice in the uranium leaching industry is to case and cement the sidewalls of the wells to a depth beyond the mineralized zone. Characteristically, polyvinyl chloride (PVC) is used as the casing material. The cemented casings are indicated at **12*a* and 14*a* in FIG. 1**. In the conventional systems described above, the grouted casing in the mineralized zone is removed with a mechanical reaming device and a well screen is placed in the mineralized zone to permit only essentially sand free liquid to flow into the well bore.

In operation, a surface pump (not shown) is used to inject a leachant into the injection well which passes therefrom through the mineralized zone 10 in the direction indicated by arrows 16 to the recovery well 14. An electronic centrifugal suction pump 18 is located down in the well 14 and is used to recover the liquid which passes through the mineralized zone, this liquid containing the uranium or other mineral sought to be recovered. As noted, sand must not be permitted to enter the well bore because such sand drastically accelerates the wear on such downhole submersible centrifugal pumps used to lift the leachant to the surface.

As discussed hereinbefore, the present invention concerns the use of a water jet perforator for the well casings which provides dramatic improvement in the mining operation. The water jet perforator is indicated schematically at 20 in FIG. 1 and, as shown in more detail in FIG. 2, basically comprises a hose 22 connected to a pump (not shown in FIG. 2 but indicated schematically at 24 in FIG. 2), a swivel 26 supported on a swivel support frame 28, a string of high-pressure pipe 30, and a nozzle 32. A pipe coupler or couplers 34 are also employed and the nozzle 32 is connected to the pipe 30 through an elbow 36.

The pump 24 generates a pressurized flow of water which is conducted through the flexible hose 22 to the swivel 26 mounted at the top of the pipe string 30. Swivel 26 permits the pipe string 30 to be rotated and also provides a location to connect the flexible hose 22 to the pipe. The pipe string 30 is comprised of 20-foot sections connected by high-pressure couplers such as indicated at 34. The nozzle assembly, including elbow 36 and nozzle 32, at which the pipe string 30 is terminated, changes the flow direction from vertical, down the length of the pipe 30, to horizontal, at the exit of nozzle 32. It will be appreciated that the nozzle converts the high-pressure energy of the water into kinetic energy thereby producing the cutting jet.

Considering a specific embodiment of the invention, the pump 24 can be a Kobe Size 4J 30,000 psi horizontal triplex pump driven by a 150 h.p. 1,800 rpm motor. the triplex pump is equipped with either a 1 1/16 inches or ⅝ inch diameter plunger and liner assemblies and has a 5-inch stroke. When the pump is fitted with the 1 1/16 inches diameter plunger and liner assembly, 21 gpm is displaced at a pressure of 10,000 psi. When the pump is fitted with a ⅝ inch diameter plunger and liner assembly, 7gpm at 30,000 psi pressure is displaced. In general, the water pressure utilized is between 8,000 and 25,000 psi, with 10,000 psi being used for many applications.

The piping 30 is, as stated, composed of 20-foot lengths of 1 inch 0D by 9/16 inch 1D, 316 stainless steel, 15,000 psi working pressure seamless pipe. The nozzle assembly comprises the high-pressure elbow 36 with a welded steel centralizer and containing a Nikonov-Shavlovskii nozzle 32 in the outlet port. Nozzle 32 is illustrated in FIG. 3 and includes a 13° conical taper ($\alpha = 13°$) with a straight section adjacent to the nozzle outlet. The nozzle 32 is constructed of beryllium-copper and heat treated, after machining, to minimize wear caused by the fluid jet. Preliminary tests have indicated that it is necessary to use nozzle diameters less than 0.018 inch or pressures in excess of 10,000 psi to provide acceptable perforations. Further, nozzles with diameters of 0.018 inch or less or impractical in a field environment because of plugging problems. Moreover, in the nozzle size range of 0.026 to 0.043 inch, the larger diameter nozzles appear to be more effective.

It is noted that in order to raise and lower the water jet perforator within the borehole, the perforator tool is suspended from a device (not shown) which is designed for this purpose, such as a Smeal derrick fitted with a reel and cable.

As stated hereinabove, in accordance with a very important feature of the invention, the perforations made in the production or recovery well 14 are arranged so as to enhance flow through the mineralized zone. In this regard, when water enters a production well it will flow toward the intake of the pump (pump 18) which is usually located just above the screen referred to above. The physics of the pump suction causes most of the water to enter into the well bore at the top of the screen section, thereby forcing most of the leachant to flow across the top of the screen interval. Thus, mineralization located toward the base of the screened section is less accessible to leachant. By placing the perforations in the production well in such a manner that the perforation density is greatest at the base of the mineralized zone and least at the top nearest the pump, the leachant can be forced to flow uniformly through the length (height) of the mineralized zone. Further, in addition to providing a graded hole pattern, the holes can be limited to the side of the casing adjacent the mineralized zone. In general, the holes produced by the perforator in the recovery section are about 0.1 inch in diameter. It will be understood that since the injection well does not use such a pump, the gradation of the perforations, described above with respect to production wells, is not necessary in injection wells and a more uniform pattern would typically be used.

The number of perforations actually used is a matter of choice to some extent, with exemplary field operations employing 209 perforations in a 12.5 ft. zone, at a bottom depth of 436 ft.; 310 perforations in a 7.5 ft. zone, at a bottom depth of 438.5 ft.; 326 perforations in a 9 ft. zone, at a bottom depth of 425 ft.; 125 perforations in a 7.75 ft. zone, at a bottom depth of 425.25 ft.; 250 perforations in a 9 ft. zone, at a bottom depth of 425 ft.; and 532 perforations in a 13 ft. zone, at a bottom depth of 258 ft.

As discussed hereinabove, the method of the invention provides many important advantages over prior art techniques. One of the most important of these is the very dramatic increase in the so-called "injectivity" and hence productivity of the wells immediately after perforation. In fact, the injectivity rates of the various wells referred to in the examples in the proceeding paragraph have been so vastly improved that the input to all of the wells was subsequently throttled.

It should be noted that the invention has been described with respect to uranium mining but that the same method is also applicable to, for example, copper leaching.

More generally, although the invention has been described relative to an exemplary embodiment thereof, it will be understood that other variations and modifications can be effected in these embodiments without departing from the scope and spirit of the invention.

We claim:

1. In a solution mining method wherein an injection well and at least one recovery well are employed which extend at least to the depth of a mineralized zone and a leaching solution is pumped from the injection well through the mineralized zone to the recovery well and pumped up from the latter in a liquid solution containing the mineral to be recovered and wherein the walls of said wells include a cemented plastic casing, the improvement in said method comprising the step of perforating the cemented plastic casing of the walls of said injection well and said at least one recovery well using a high pressure water jet so as to provide a plurality of holes therein, the pressure of said high pressure jets being several thousand psi, said holes in the recovery well being on a non-uniform, predetermined pattern along the height of the well adjacent to the mineralized zone with their greatest density being near the bottom of the mineralized zone and the least density of holes being adjacent to the top of the mineralized zone.

2. A method as claimed in claim 1 wherein the plurality of holes are provided in the well casing solely on the side of the casing adjacent to the mineralized zone.

3. In a solution mining method wherein an injection well and at least one recovery well are employed to extract minerals from a mineralized zone located therebetween, the wells extending to a depth which is at least that of the mineralized zone and at least the recovery well including a casing on the side walls thereof, and wherein a leaching solution is pumped from the injection well through the mineralized zone to the at least one recovery well and pumped from the latter in a liquid solution containing the mineral to be recovered, the improvement wherein a high pressure jet is used to perforate the casing of the recovery well to provide a plurality of holes therein arranged in a nonuniform pattern along the height of the casing adjacent to the mineralized zone so as to obtain a substantially uniform flow through said mineralized zone, said pattern of holes being such that the density of holes is greatest at the base of the mineralized zone and least at the top of the mineralized zone.

4. A method as claimed in claim 3 wherein said jet comprises an abrasive-free water jet.

5. In a solution mining method wherein there is an injection well with a cemented plastic casing wall and a recovery well with a cemented plastic wall which are employed to extend at least to the depth of a mineralized zone comprising the steps of (a) perforating the plastic casing walls of said injection and recovery well with a high abrasive-free high pressure water jet to form a non-uniform predetermined pattern of holes along the height of the well adjacent to the mineralized zone so as to provide uniform flow of a leaching solution; and (b) pumping a leaching solution from the injection well by way of the holes perforated in its plastic casing through the mineralized zone and to the recovery well and surface.

* * * * *